US006631804B2

(12) United States Patent
Wong

(10) Patent No.: US 6,631,804 B2
(45) Date of Patent: Oct. 14, 2003

(54) DISPLAYABLE LIGHTER PACKAGE

(75) Inventor: Tommy Wong, El Monte, CA (US)

(73) Assignee: Zreative Products, Inc., El Monte, CA (US)

( * ) Notice: Subject to any disclaimer, the term of this patent is extended or adjusted under 35 U.S.C. 154(b) by 0 days.

(21) Appl. No.: 09/924,243

(22) Filed: Aug. 9, 2001

(65) Prior Publication Data

US 2003/0029768 A1 Feb. 13, 2003

(51) Int. Cl.[7] ..... B65D 85/00

(52) U.S. Cl. ..... 206/526; 206/523; 206/501; 211/144; 211/131.1; 220/4.27

(58) Field of Search ..... 206/526, 523, 206/588, 499, 501, 557; 211/144, 131.1, 163, 126.2; 220/4.26, 4.27, 4.28, 4.33, 4.34, 23.83; 312/305

(56) References Cited

U.S. PATENT DOCUMENTS 547,552 A * 10/1895 Keegan ..... 312/202
2,694,495 A * 11/1954 Faures ..... 211/74
3,982,800 A * 9/1976 Gorton et al. ..... 312/305
4,549,664 A * 10/1985 Gowan et al. ..... 211/131.1
4,640,418 A * 2/1987 Lowry ..... 206/499
4,901,846 A * 2/1990 Lehman ..... 206/1.8
D361,223 S * 8/1995 Sanson ..... D6/457
5,458,243 A * 10/1995 McBride ..... 206/503

* cited by examiner

*Primary Examiner*—J. Mohandesi
(74) *Attorney, Agent, or Firm*—Raymond Y. Chan; David & Raymond Patent Group

(57) ABSTRACT

A displayable lighter package includes a display stand including a circular upper deck having an upper receiving cavity, a circular lower deck having a lower receiving cavity, and a central supporting shaft detachably supported between the upper deck and the lower deck in a rotatably movable manner. A lighter holder arrangement for securely holding at least a lighter on the display stand includes an upper holder and a lower holder fittedly disposed in the upper and lower receiving cavities respectively, wherein a plurality of upper holding slots are radially formed on the upper and lower holders respectively and adapted for securely supporting bottom portions of lighters on the upper and lower holders respectively. A stand base is detachably mounted underneath said lower deck for enabling said display stand in a rotatably movable manner. A cover is detachably sheltered the display stand for protecting the lighters mounted thereon.

14 Claims, 5 Drawing Sheets

DISPLAYABLE LIGHTER PACKAGE

BACKGROUND OF THE PRESENT INVENTION

1. Field of Invention

The present invention relates to lighters, and more particularly to a displayable lighter package for packaging storing and 3-dimensionally displaying lighters.

2. Description of Related Arts

Lighters have been known and sold throughout the United States. In order to pack and display the lighters in a store, a box shaped container is used. Conventional, the container has a plurality of storage chambers provided in the container, as shown in FIG. 1, such that the lighters are aligned and respectively disposed in the storage chambers of the container. Therefore, by placing a cover to enclose the container, the lighters can be packed and stored orderly such that the container is commonly used for packaging the lighters nowadays.

However, a significant drawback of the container is that the lighters cannot be displayed properly. Since the lighters are aligned in the container, the view of the lighters in the back rows will be blocked by the front row of the lighters. It is fine if all the lighters have the same appearance such that the lighters at the front row can be displayed all entire bunch of lighters. However, when the lighters have different sizes and shapes, such as piezoelectric lighters and disposable lighters, the lighters may not be displayed properly in the container Moreover, due to the different sizes of the lighters, the storage chambers having a uniform size may not fit to support the lighters. It is unreasonable for the manufacturer to produce different sizes of the storage chambers for fittedly supporting the lighters. As a result the lighters may easily come out of the container. So people always have conflict between packaging and displaying. Ignoring the right packaging may depreciate the value of the product as well.

SUMMARY OF THE PRESENT INVENTION

A main object of the present invention is to provide a displayable lighter package, which does not employ expensive or complicate structure, so as to successfully provide an economic and efficient solution for packaging storing, and displaying the lighters.

Another object of the present invention is to provide a displayable lighter package, which comprises at least a lighter stand not only for orderly supporting the lighters thereon for packaging purpose but also for easily setting up for display purpose.

Another object of the present invention is to provide a displayable lighter package, which enables the lighters to be displayed 3-dimensionally so as to enhance the aesthetic appearance of the lighters.

Another object of the present invention is to provide a displayable lighter package, which can fittedly support all kinds of lighters having different sizes and shapes, so as to prevent the lighters from being dislodged from the displayable lighter package.

Accordingly, in order to accomplish the above objects, the present invention provides a displayable lighter package, comprising:

a display stand comprising a circular upper deck having an upper receiving cavity, a circular lower deck having a lower receiving cavity, and a central supporting shaft having a predetermined height detachably supported between the upper deck and the lower deck in a rotatably movable manner;

a lighter holder arrangement for securely holding at least a lighter on the display stand comprising an upper holder and a lower holder fittedly disposed in the upper and lower receiving cavities of the upper and lower decks respectively, wherein a plurality of upper holding slots are radially formed on the upper and lower holders respectively and adapted for securely supporting bottom portions of lighters on the upper and lower holders respectively; and a cover detachably sheltered the display stand for protecting the lighters mounted thereon.

DETAILED DESCRIPTION OF THE PREFERRED EMBODIMENT

Figure 1:
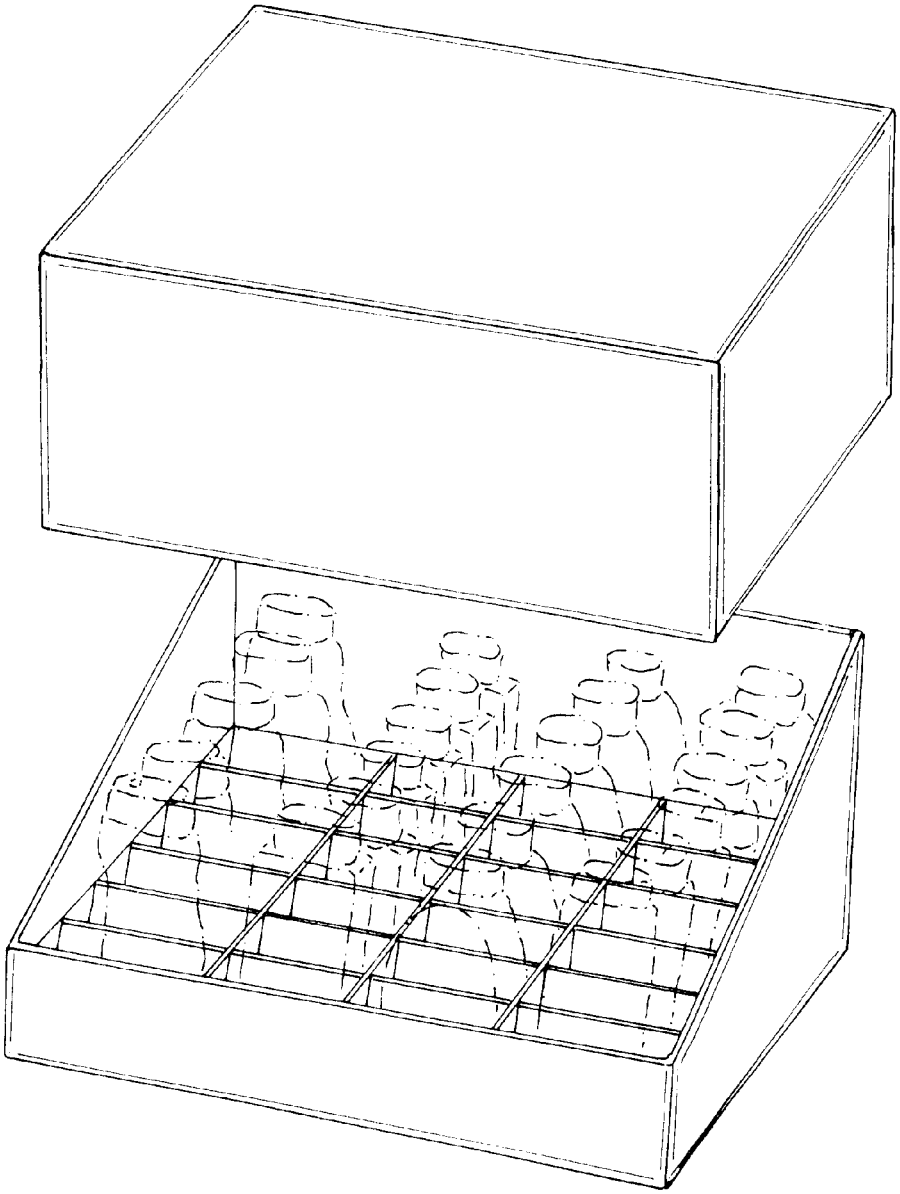
FIG. 1 PRIOR ART
FIG. 1 is a perspective view of a conventional lighter package.
Figure 2:
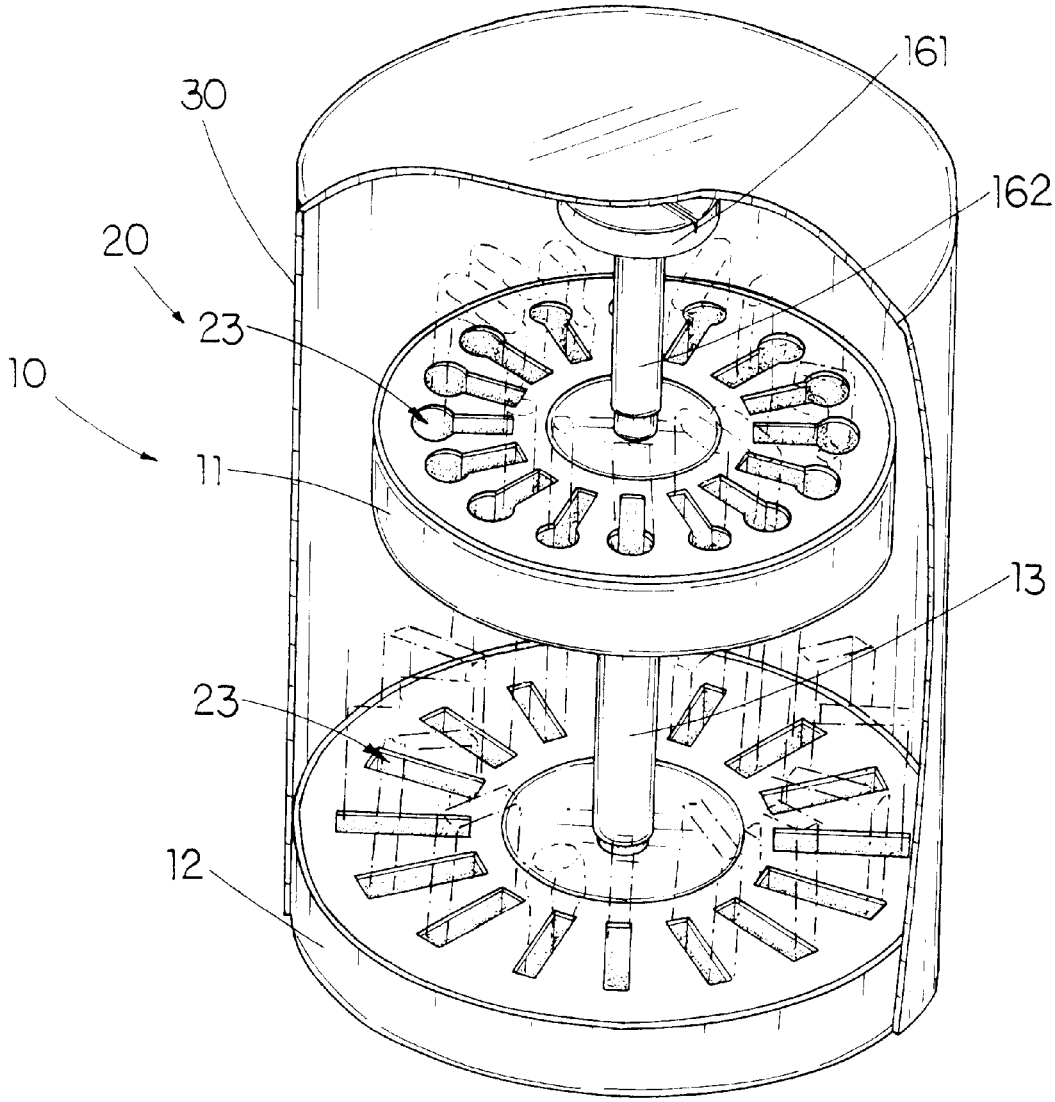
FIG. 2 is a perspective view of the lighters supported on a displayable lighter package according to a preferred embodiment of the present invention.

Referring to FIG. 2 of the drawings a displayable lighter package according to a preferred embodiment of the present invention is illustrated, wherein the displayable lighter package is capable of displaying a plurality of lighters 3-dimensionally.

Figure 3:
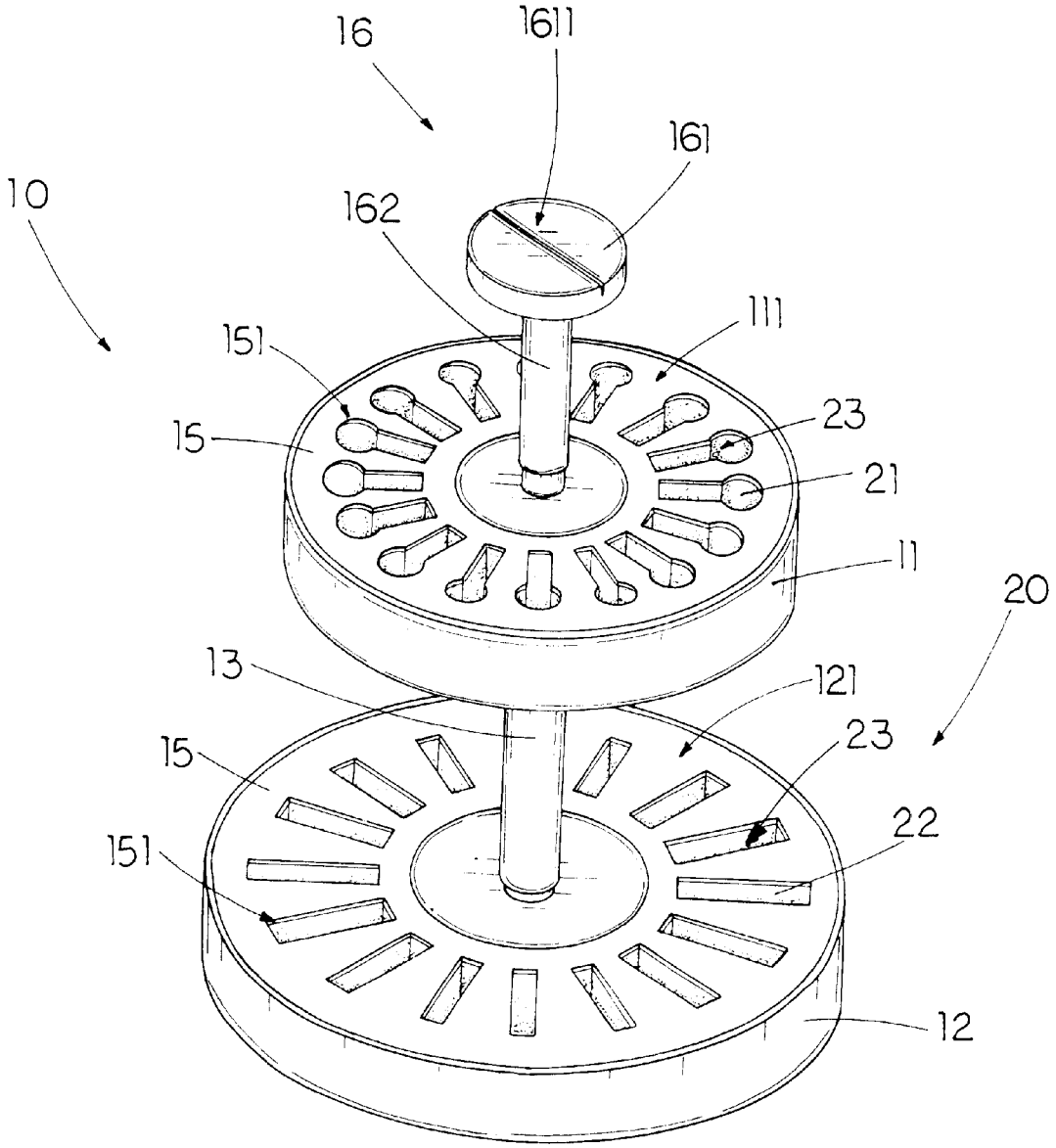
FIG. 3 is a perspective view of the displayable lighter according to the above preferred embodiment of the present invention.

As shown in FIG. 3, the displayable lighter package comprises a display stand 10, a lighter holding arrangement 20 for securely holding at least a lighter on the display stand 10, a stand base 14 rotatably mounted underneath the display stand 10, and a cover 30 detachably sheltered the display stand for protecting the lighters mounted thereon.

The display stand 10 comprises a circular upper deck 11 having an upper receiving cavity 111, a circular lower deck 12 having a lower receiving cavity 121, and a central supporting shaft 13 having a predetermined height detachably supported between the upper deck 11 and the lower deck 12 in a rotatably movable manner.

The lighter holder arrangement 20 comprises an upper holder 21 and a lower holder 22 fittedly disposed in the upper and lower receiving cavities 111, 121 of the upper and lower decks 11, 12 respectively, wherein a plurality of holding slots 23 are radially formed on the upper and lower holders 21, 22 respectively and adapted for securely supporting bottom portions of lighters on the upper and lower holders 21, 22 respectively.

According to the preferred embodiment, the display stand 10 is made of lightweight but durable material such as plastic that can be easily be manufactured by molding techniques commonly known to those skilled in the art so as to minimize the manufacturing cost of the present invention.

The supporting shaft 13 having a tubular shaped has an upper end rotatably attached to a bottom side of the upper deck 11 and a lower end rotatably attached to an upper side of the lower deck 12 in such a manner that the upper deck 11 and the lower deck 12 are supported in a parallel manner. Thus, the supporting shaft 13 has a height must be longer than a height of the lighter so as to ensure the lighters can be properly supported on the lower deck 12 without disturbing by the upper deck 11.

For attaching the supporting shaft 13 to the upper deck 11 and the lower deck 12 respectively, the upper deck 11 has a tubular housing 112 downwardly and integrally protruded from the bottom side of the upper deck 11 at a center thereof and the lower deck 12 has a central axle 122 upwardly and integrally protruded from a top side of the lower deck 12 in such a manner that the upper end of the supporting shaft 13 is rotatably inserted into tubular housing 112 of the upper deck 11 and the central axle 122 of the lower deck 12 is rotatably inserted into the lower end of the supporting shaft 13.

Figure 4:
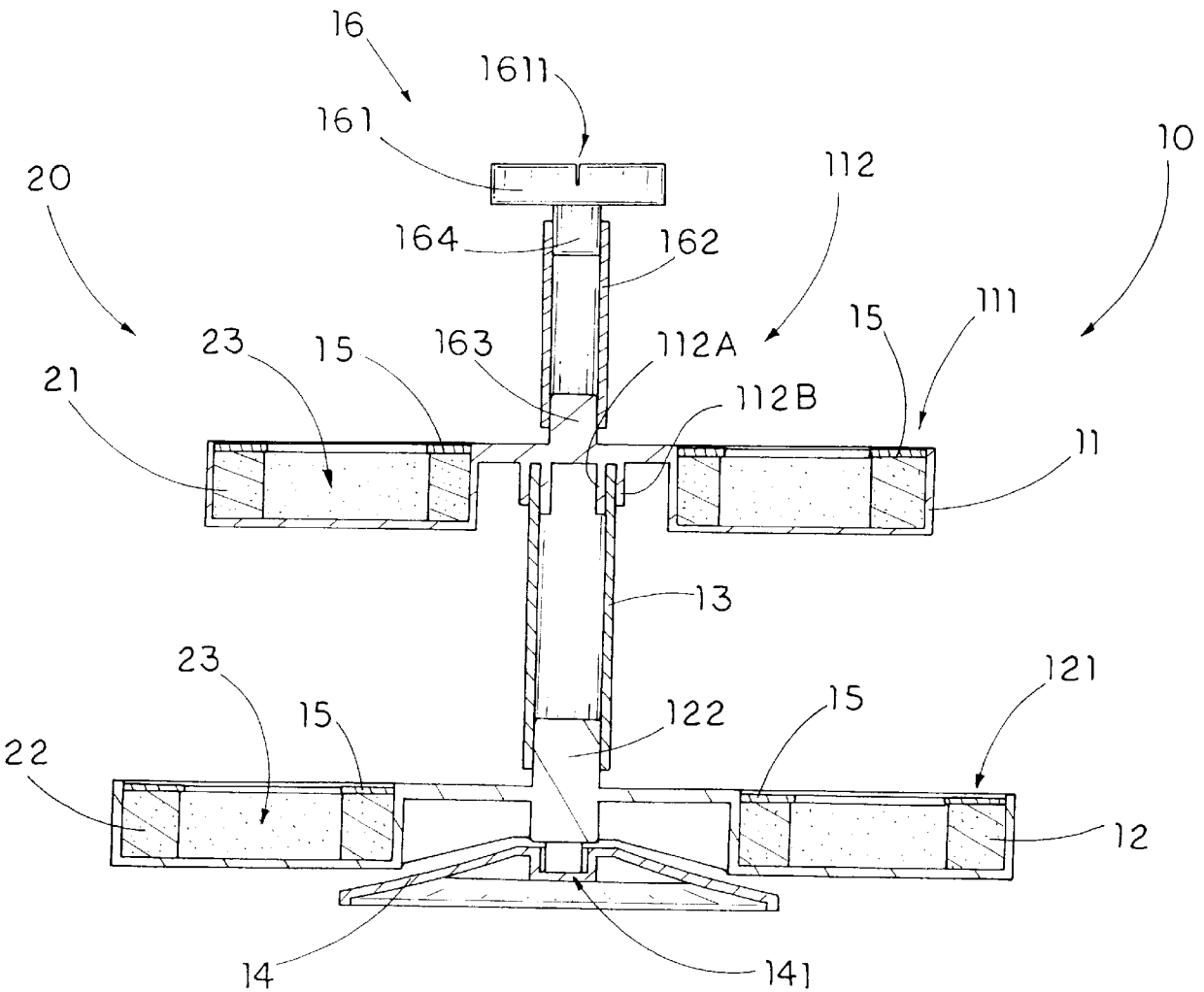
FIG. 4 is sectional view of the displayable lighter package according to the above preferred embodiment of the present invention.

As shown in FIG. 4, the tubular housing 112 comprises two coaxial walls 112*a*, 112*b* spacedly extended from the center of the upper deck 11 wherein the upper end of the supporting shaft 13 is mounted between the two coaxial walls 112*a*, 112*b* of the tubular housing 112 so as to ensure the rotational movement of the upper deck 11 with respect to the supporting shaft 13.

A diameter of the upper deck 11 is smaller than that of the lower deck 12, which can create more display space of the lower deck 12 to prevent views of the lighters supported on the lower deck 12 being blocked by the upper deck 11. Thus, the lighters on the lower deck 12 can be easily taken therefrom without being blocked by the upper deck 11.

Each of the upper and lower holder 21, 22 having a predetermined width is fittedly disposed in each of the upper and lower receiving cavities 111, 112 wherein the upper and lower holders 21, 22 are made of foaming material adapted for deforming into a predetermined shape when an external force is exerted thereon.

The holding slots 23 are elongated through slots radially formed on the upper and lower holders 21, 22 respectively wherein each of the holding slots 23 has a predetermined size adapted for securely holding the bottom portion of the lighter in such a manner that the lighters are arranged to be coaxially supported on the display stand 10 so as to display the lighters 3-dimensionally.

It is worth to mention that since the upper and lower holders 21, 22 are made of foaming material, when the lighters are mounted on the holding slots 23, sidewalls of the holding slots 23 will be self-deformed into a shape to fit the shapes of the lighters. Thus, the upper and lower holders 21, 22 also apples an urging pressure against the lighters at the sidewalls of the holding slots 23 respectively so as to retain the lighters on the display stand 10.

Figure 5A:
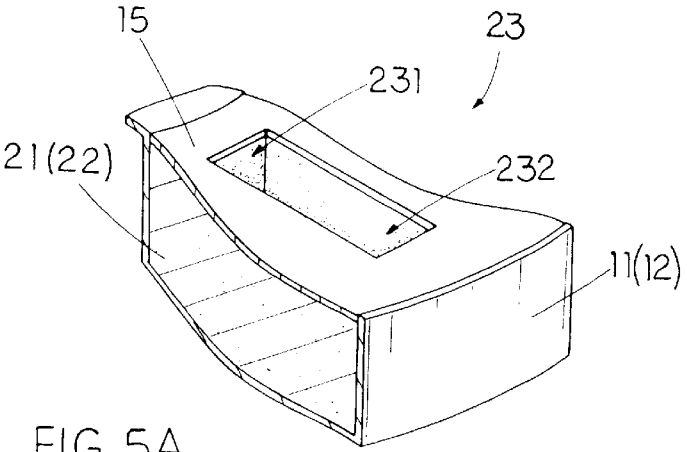
FIGS. 5A to 5D illustrate a holding slot and its alternative mode of the displayable lighter package according to the above preferred embodiment of the present invention.

Accordingly each of the holding slots 23 has an inner tail portion 231 and an outer head portion 232 wherein the tail portion 231 of the holding slot 23 has a width equal to a width of the head portion 232 thereof so as to form a rectangular shaped holding slot 23, as shown in FIG. 5A.

Figure 5B:
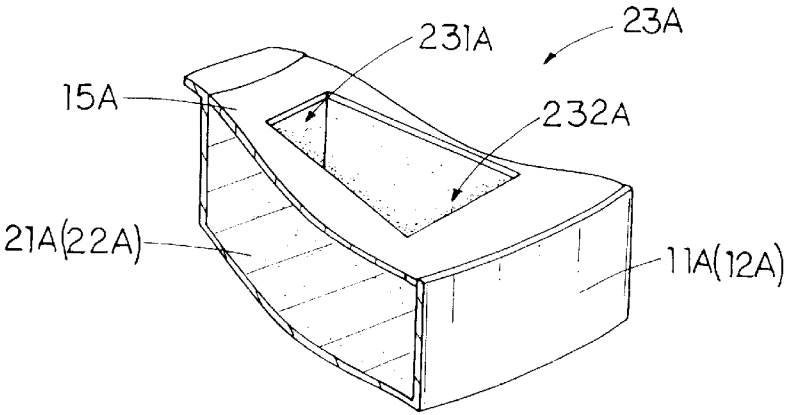
Figure 5C:
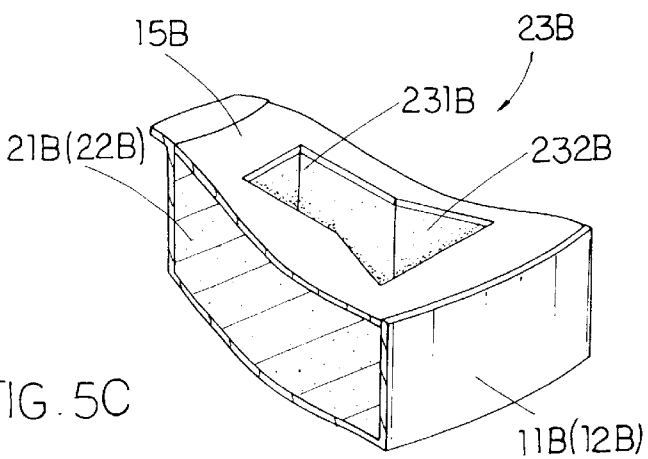
Figure 5D:
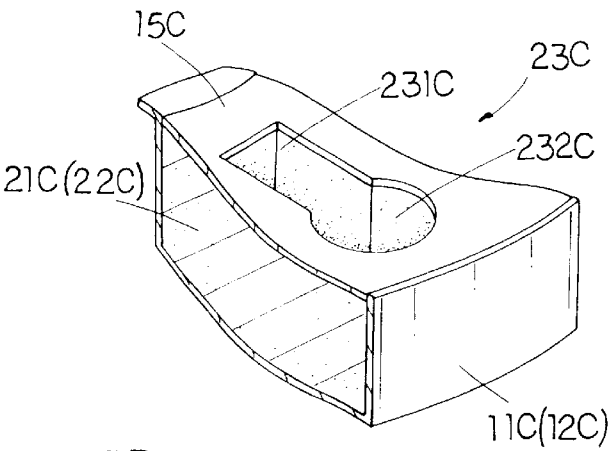

As shown in FIGS. 5B to 5D, the holding slot 23 can be formed in any shape to fit the shape of the lighter. Each of the holding slots 23A has a width gradually decreasing from the head portion 232A to the tail portion 231A so as to form a trapezoid shape, as shown in FIG. 5B. Alternatively, the tail portion 231B of the holding slot 23B has a uniform width and the head portion 232B of the holding slot 23B has a gradually decreasing width towards to the tail portion 231B thereof, as shown in FIG. 5C. Thus, the tail portion 231C of the holding slot 23C has a uniform width and the head portion 232C of the holding slot 32C has an enlarged round shape as shown in FIG. 5D.

The stand base 14, having a center hole 141, is detachably mounted on a bottom side of the lower deck 12 in a rotatably movable manner wherein the lower deck 12 further has a center projection 122 downwardly protruded from the bottom side of the lower deck 12 and arranged to rotatably insert into the center hold 141 of the stand base 14, so as to mount the display stand 10 on the stand base 14.

The cover 30 can be made of any material such as paper or plastic, which is in low cost, for sheltering the display stand 10 to form a package in such a manner that when the cover 30 is detached from the display stand 10, the lighters mounted on the upper and lower decks 11, 12 are already to display.

The displayable lighter package further comprises a tag stand 16 upwardly extended from the upper deck 11 and two reinforcing panels 15 mounted on top of the upper and lower holders 21, 22 respectively.

The tag stand 16 comprises a tag platform 161 having a mounting groove 1611 transversely formed thereon for a tag mounted on the tag platform 161, and a supporting arm 162 vertically supported between the upper deck 11 and the tag platform 161.

Accordingly, a first protrusion 163 is upwardly protruded from a top side of the upper deck 11 and a second protrusion 164 is downwardly protruded from a bottom side of the tag platform 161 wherein the supporting arm 162 having a tubular shaped has two ends detachably being inserted into the first protrusion 163 and the second protrusion 164 respectively, so as to mount the tag platform 161 on the display stand 10.

The two reinforcing panels 15, each having a corresponding shape, are fittedly attached on top of the upper and lower holders 21, 22 wherein each reinforcing panel 15 has a plurality of corresponding cutouts 151 aligned with the holding slots 23 in such a manner that the reinforcing panels 15 are adapted for reinforcing a shape of the holding slots 23 from being distorted when the lighters are mounted thereon.

In view of the above preferred embodiment the present invention can be concluded to provide the following advantages.

1. Since the displayable lighter package is easy to manufacture and its manufacturing cost is relatively low, the present invention can provide an economic and efficient solution for packaging, storing, and displaying the lighters.

2. The lighters are already packed on the upper and lower decks orderly such that the user can simply open the cover and set up the display stand, all the lighters are ready to display.

3. The assembly of the display stand is simple and easy that every individual is able to set up the display stand in seconds.

4. All the lighters can be displayed 3-dimensionally. Since the lighters are coaxially supported on the upper and lower decks respectively the lighters will not be blocked by each other, even though the lighters have different sizes. Thus, by turning the upper and lower decks, the user is able to select the desired lighter easily.

5. The displayable lighter package of the present invention can display different kinds of lighters at the same time. Any shape of the lighter can be mounted on the holding slot such that more than one kind of lighter can be displayed at the same time.

What is claimed is:

1. A displayable lighter package, comprising:

a display stand comprising a circular upper deck having an upper receiving cavity, a circular lower deck having a lower receiving cavity, and a central supporting shaft having a predetermined height detachably supported between said upper deck and said lower deck in a rotatably movable manner, wherein a diameter of said upper deck is smaller than that of said lower deck, wherein said supporting shaft with a tubular shape has an upper end rotatably attached to a tubular housing downwardly protruded from a bottom side of the upper deck and a lower end being rotatably inserted into a center axle upwardly protruded from a top side of said lower deck, wherein said tubular housing comprises two coaxial walls spacedly extended from a center of said upper deck wherein said upper end of said supporting shaft is mounted between said two coaxial walls of said tubular housing so as to ensure a rotational movement of said upper deck with respect to said supporting shaft;

a lighter holder arrangement for securely holding at least a lighter on said display stand comprising an upper holder and a lower holder fittedly disposed in said upper and lower receiving cavities of said upper and lower decks respectively, wherein a plurality of upper holding slots are radially formed on said upper and lower holders respectively;

a stand base detachably mounted underneath said lower deck for enabling said display stand in a rotatably movable manner; and a cover detachably sheltering said display stand.

2. A displayable lighter package, as recited in claim 1 further comprising a tag stand which comprises a tag platform having a mounting groove transversely formed thereon for a tag to be mounted thereon, and a supporting arm vertically supported between said upper deck and said tag platform.

3. A displayable lighter package, as recited in claim 2, wherein said tag stand further has a first protrusion upwardly protruded from a top side of said upper deck and a second protrusion downwardly protruded from a bottom side of said tag platform wherein said supporting arm having a tubular shaped has two ends detachably being inserted into said first protrusion and said second protrusion respectively, so as to mount said tag platform on said display stand.

4. A displayable lighter package, as recited in claim 3, wherein said stand base, which has a center hole, is detachably mounted on a bottom side of said lower deck in a rotatably movable manner, wherein said lower deck further has a center projection downwardly protruded from said bottom side of said lower deck and arranged to rotatably insert into said center hold of said stand base, so as to rotatably mount said display stand on said stand base.

5. A displayable lighter package, as recited in claim 3, wherein each of said holding slots has an inner tail portion and an outer head portion wherein said tail portion of said holding slot has a width equal to a width of said head portion thereof so as to form said holding slot with a rectangular shape.

6. A displayable lighter package, as recited in claim 3, wherein each of said holding slots, which has an inner tail portion and an outer head portion, has a width gradually decreasing from said head portion to said tail portion so as to form said holding slot with a trapezoid shape.

7. A displayable lighter package, as recited in claim 3, wherein each of said holding slots has an inner tail portion having a uniform width and an outer head portion having a gradually decreasing width towards said tail portion of said holding slot.

8. A displayable lighter package, as recited in claim 3, wherein each of said holding slots has an inner tail portion having a uniform width and an outer head portion having an enlarged round shape.

9. A displayable lighter package, as recited in claim 2, wherein said upper and lower holders are made of foaming material adapted for deforming into a predetermined shape.

10. A displayable lighter package, as recited in claim 9, further comprising two reinforcing panels, each having a corresponding shape, attached on top of said upper and lower holders respectively, wherein each said reinforcing panel has a plurality corresponding cutouts aligned with said holding slots respectively, so as to prevent said holding slot from being distorted when said lighter is mounted thereon.

11. A displayable lighter package, as recited in claim 10, wherein each of said holding slots has an inner tail portion and an outer head portion wherein said tail portion of said holding slot has a width equal to a width of said head portion thereof so as to from said holding slot with a rectangular shape.

12. A displayable lighter package, as recited in claim 10, wherein each of said holding slots, which has an inner tail portion and an outer head portion, has a width gradually decreasing from said head portion to said tail portion so as to form said holding slot with a trapezoid shape.

13. A displayable lighter package, as recited in claim 10, wherein each of said holding slots has an inner tail portion having a uniform width and an outer head portion having a gradually decreasing width towards said tail portion of said holding slot.

14. A displayable lighter package, as recited in claim 10, wherein each of said holding slots has an inner tail portion having a uniform width and an outer head portion having an enlarged round shape.

* * * * *